US005370055A

United States Patent [19]

Fugelso et al.

[11] Patent Number: 5,370,055

[45] Date of Patent: Dec. 6, 1994

[54] THREE-PHASE HYPERVELOCITY PROJECTILE LAUNCHER

[75] Inventors: L. Erik Fugelso; Gerald C. Langner; Kerry L. Burns; James N. Albright, all of Los Alamos, N. Mex.

[73] Assignee: The Regents of the University of California, Office of Technology Transfer, Alameda, Calif.

[21] Appl. No.: 137,686

[22] Filed: Oct. 15, 1993

[51] Int. Cl.[5] ..... F42B 1/02; F42B 3/08; F42B 12/10; F42B 12/16

[52] U.S. Cl. ..... 102/308; 89/1.15; 102/476; 175/4.6

[58] Field of Search ..... 102/306, 307, 308, 309, 102/310, 475, 476, 701; 89/1.15; 166/55.2; 175/4.6, 4.5, 4.57

[56] References Cited

U.S. PATENT DOCUMENTS 4,004,515 1/1977 Mallory et al. ..... 102/308
4,672,896 6/1987 Precoul et al. ..... 102/309
4,860,654 8/1989 Chawla et al. ..... 102/306
4,955,939 9/1990 Petrousky et al. ..... 102/476
5,166,469 11/1992 Kerdraon et al. ..... 102/308
5,223,666 6/1993 Delaney ..... 102/476

*Primary Examiner*—David Brown
*Attorney, Agent, or Firm*—Ray G. Wilson

[57] ABSTRACT

A hypervelocity projectile launcher for use in perforating borehole casings provides improved penetration into the surrounding rock structure. The launcher includes a first cylinder of explosive material that defines an axial air-filled cavity, a second cylinder of explosive material defining an axial frustum-shaped cavity abutting and axially aligned with the first cylinder. A pliant washer is located between and axially aligned with the first and second cylinders. The frustum shaped cavity is lined with a metal liner effective to form a projectile when the first and second cylinders are detonated. The washer forms a unique intermediate projectile in advance of the liner projectile and enables the liner projectile to further penetrate into and fracture the adjacent rock structure.

3 Claims, 1 Drawing Sheet

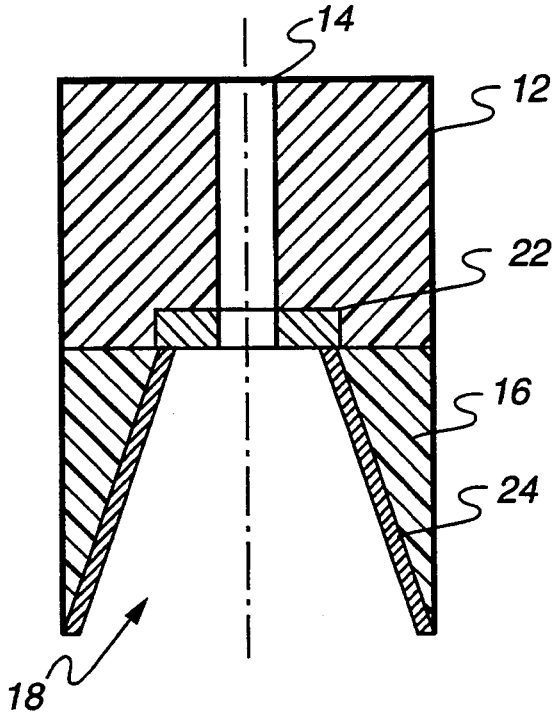
14
12
22
16
24
18

THREE-PHASE HYPERVELOCITY PROJECTILE LAUNCHER

BACKGROUND OF THE INVENTION

This invention relates to shaped explosive charges and, more particularly, to shaped explosive charges for stimulating oil well production, and the like. This invention was made with government support under Contract No. W-7405-ENG-36 awarded by the U.S. Department of Energy. The government has certain rights in the invention.

Extracting all or most of the petroleum from an oil field has been a goal for many years. Petroleum generally is not found in underground pools, but is found within rock strata and flows along rock fractures to various collection points for production. In production wells, boreholes are drilled into a petroleum-bearing rock strata and the holes are typically lined with steel casings that are cemented in place. The casings are perforated in place to form radial fractures from the casing wall into the surrounding rock to permit petroleum to flow into the well bore.

Conventional perforating techniques include bullets fired through the casing into the surrounding rock, hydraulic perforating and fracturing, and explosive shaped charges. Explosive devices are used to perforate production casing within a borehole and to fracture the rock surrounding the borehole to increase the permeability of the oil-bearing rock strata near the borehole and increase the fluid flow into the production casing.

It will be appreciated, however, that space for explosive devices is limited by the size of the production casing. Also, the casing must be perforated without destroying the integrity of the casing and causing the surrounding borehole to collapse. These effects limit the effectiveness of conventional explosives. Shaped charges have been used to increase the volume of rock strata fractured by the explosive charge, but an increased volume that is fractured is high desirable.

Accordingly, it is an object of the present invention to provide for increased fracture volume in a rock strata surrounding the borehole casing about a production zone.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a hypervelocity projectile launcher. A first cylinder of explosive defines an axial air-filled cavity. A second cylinder of explosive defines an axial frustum-shaped cavity. The first cylinder is mounted above the second cylinder and separated therefrom by a pliant washer, i.e., a cylindrical member of pliant material with an axial opening therethrough. The frustum-shaped cavity is lined with a metal effective to form a projectile when the explosive cylinders are detonated.

BRIEF DESCRIPTION OF THE DRAWINGS

The accompanying drawing, which is incorporated in and form a part of the specification, illustrate an embodiment of the present invention and, together with the description, serves to explain the principles of the invention. The Figure is a cross-sectional view of one embodiment of the present invention.

DETAILED DESCRIPTION OF THE INVENTION

Referring now to the Figure, there is shown in cross-section one embodiment of a three-phase hypervelocity-projectile launcher that requires little or no standoff from an object that is to be perforated, e.g., a borehole liner. A first cylinder 12 of a high explosive material defines axial cylindrical cavity 14 is mounted above a second cylinder 16 of a high explosive material that defines frustum-shaped cavity 18. First cylinder 12 is separated from second cylinder 16 by washer 22 formed from a thin cylinder of a pliant material, such as plastic, and defining an axial hole therethrough that generally aligns with cylindrical cavity 14. A truncated conical liner 24 of a ductile-metal liner, e.g., copper and the like, lines the interior surface of cavity 18. First cylinder 12, washer 22, and second cylinder 16 are mounted sequentially, with their axes of symmetry aligned collinearly.

A detonation system, not shown, is used to initiate detonation in first cylinder 12. A suitable detonation system may consist of a plane-wave detonator or a rim-fired detonator, i.e., a system with a single-point detonator that ignites a disk of high explosive, which is backed by a metal wave shaper, wherein the detonation arrives at the main cylinder of high explosive at the outside rim. The detonation devices are well-known and do not form a part of the present invention.

The assembled device shown in the Figure is placed within a down-hole tool and positioned within the casing lining a borehole. The device may be placed with a zero, or very small, standoff from the casing wall. When the device is detonated, the high explosive material forming first cylinder 12 forms a strong air shock wave that is delivered to the casing through axial cavities 14 and 18. The shock wave strikes and perforates the wall of the casing in the borehole, utilizing the internal standoff created by second cylinder 16.

As the detonation continues, washer 22 collapses toward the axis of symmetry from the shock wave and from air drag through the center of the washer induced by the air shock in the central cavity. The washer forms a high velocity explosively-formed projectile that passes through the perforation in the casing caused by the initial air shock wave. The impact of the projectile formed from washer 22 on the surrounding rock strata causes fractures to initiate in the rock. Ductile metal liner 24 then collapses under the influence of the lower shaped-charge effect of the detonating second cylinder 16 and forms a high-velocity explosively-formed projectile in a conventional manner. This third phase projectile is launched into the rock strata to further propagate the fractures initiated by the projectile formed from washer 22 and creates an enlarged axial cavity in the rock strata, thus allowing for increased fluid flow to the volume surrounding the casing and concomitant fluid production through the casing.

Referring again to FIG. 1, an explosive device was assembled with the following design

| | |
|---|---|
| Explosive cylinder 12 | 25.4 mm long by 38.1 mm diameter PBX-9501 explosive; 50.3 g |
| Axial cavity 14 | 6 mm diameter |
| Washer 22 | 3 mm thick by 18.8 mm diameter, 6 mm diameter hole nylon |
| Explosive cylinder 16 | 25.4 mm long by 38.1 mm diameter PBX-9501 explosive, 23.9 g |
| Conical liner 24 | Copper, cone angle 40° full angle; 1 mm thick |

The copper cone was copper 101, an oxygen-free high-conductivity copper that had been punched, cold-worked, and stress-relieved at 350° C. for 1 hour, with final machining after the heat-treating process.

A Eularian code simulation was performed for the projectile design shown in the Figure. The simulation showed that a strong air jet originates in the axial cavity 14 from the converging detonation wave from the detonation of explosive cylinder 12. The air shock expands into frustum-shaped cavity 18 and makes the first contact with the target. Next, nylon washer 22 forms a projectile that interacts with and penetrates the surrounding metal case. Liner 24 then forms a second projectile for penetrating the surrounding strata.

A test was performed on a Berea sandstone target encased in a 0.25 in.-thick (6.35 mm) mild-steel plate and capped at both ends with a 0.25 in.-thick (6.35 mm) mild-steel plates. The top plate models an oil well casing. The sandstone target was 8.75 in. (222.2 mm) diameter by 12.25 (311.2 mm) long. The volume between the sandstone cylinder and the steel jacket was filled with epoxy. The projectile launcher was centered on the top end of the target with a 3.1 mm stand-off The resulting cavity reached the bottom of the target and the bottom plate was actually also deformed, indicating that the explosively-formed copper projectile still had significant momentum when it struck the bottom plate. The maximum width of the cavity was about 37 mm and occurred about 28 mm from the front surface of the target.

Thus, the simulation and test demonstrates that the hypervelocity projectile launcher according to the present invention provides significant fracturing in the volume of rock strata that is adjacent the projectile launcher. The deep penetration of the perforation and the volume of rock fractured should provide oil-well perforations with concomitant increased production of oil from the surrounding strata.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A hypervelocity projectile launcher for use in perforating borehole casings, comprising:

a first cylinder of explosive material defining an axial air-filled cavity;

a second cylinder of explosive material defining an axial frustum-shaped cavity abutting and axially aligned with said first cylinder;

a pliant washer between and axially aligned with said first and second cylinders; and a metal liner lining said frustum-shaped cavity effective to form a projectile when said first and second cylinders are detonated.

2. A hypervelocity projectile launcher according to claim 1, wherein said metal liner is copper.

3. A hypervelocity projectile launcher according to claim 1, wherein said washer is nylon.

* * * * *